US008413916B2

(12) United States Patent
Pilch et al.

(10) Patent No.: US 8,413,916 B2
(45) Date of Patent: Apr. 9, 2013

(54) FORCE RESPONSIVE SHREDDER

(75) Inventors: Alan Pilch, Hudson, OH (US); Josh Davis, Hudson, OH (US)

(73) Assignee: Techtronic Floor Care Technology Limited (VG)

( * ) Notice: Subject to any disclaimer, the term of this patent is extended or adjusted under 35 U.S.C. 154(b) by 332 days.

(21) Appl. No.: 12/848,419

(22) Filed: Aug. 2, 2010

(65) Prior Publication Data

US 2012/0024991 A1 Feb. 2, 2012

(51) Int. Cl.
*B02C 25/00* (2006.01)

(52) U.S. Cl.
USPC ..... 241/30; 241/36; 241/100; 241/236

(58) Field of Classification Search ..... 241/30, 241/36, 100, 236, 230–234, 286–290
See application file for complete search history.

(56) References Cited

U.S. PATENT DOCUMENTS 4,411,391 A * 10/1983 Crane ..... 241/232
4,793,561 A 12/1988 Burda
4,986,481 A 1/1991 Fujii et al.
5,662,280 A 9/1997 Nishio et al.
5,772,129 A 6/1998 Nishio et al.
6,978,954 B2 12/2005 Kroger et al.
7,325,762 B2 2/2008 Marbourg
7,497,393 B2 3/2009 Abramson et al.
7,661,614 B2 2/2010 Matlin
7,712,688 B2 5/2010 Priester
2007/0246582 A1 10/2007 Aries
2008/0135655 A1 6/2008 Wang et al.
2009/0283617 A1 11/2009 Abramson et al.
2010/0176227 A1 7/2010 Davis et al.

OTHER PUBLICATIONS

PCT/US2011/046096 the International Search Report and the Written Opinion of the International Searching Authority; Date of Mailing: Mar. 22, 2012; pp. 1 through 9.

* cited by examiner

*Primary Examiner* — Mark Rosenbaum
(74) *Attorney, Agent, or Firm* — Hahn, Loeser & Parks, LLP

(57) ABSTRACT

A shredder includes a cutting assembly capable of shredding paper mounted in a shredder housing and a detector mechanism capable of shutting off the cutting assembly in response to detecting a force applied to the cutting assembly.

21 Claims, 8 Drawing Sheets

FORCE RESPONSIVE SHREDDER

BACKGROUND

This invention relates in general to shredders, such as paper shredders, for shredding paper documents and the like. Paper shredders, for example, typically include a housing with a cutting mechanism for cutting paper, i.e. shredding, and a container for collecting cut paper. The housing generally defines an opening through which papers to be shredded may pass to the cutting mechanism. Typically, the papers are then shredded by the cutting mechanism and collected in the container.

Many paper shredders include a detector deactivate the cutting mechanism. The detector may, for example, deactivate the cutting mechanism upon detection of a paper jam or upon detection of a certain state of a user.

One known detector for a paper shredder includes a detection mechanism associated with a throat plate disposed in the opening in the shredder housing. The detection mechanism may, for example, be a mechanical switch activated by movement of the throat plate relative to the housing, or a capacitive sensor responsive to matter in contact with the throat plate. In any case, the detector will not deactivate the cutting mechanism until a jam or user has engaged the throat plate.

SUMMARY

This invention relates to a shredder, such as a paper shredder, that includes a force responsive detector and a method of using such a shredder.

The shredder includes a cutting assembly capable of shredding paper mounted in a shredder housing and a detector mechanism capable of shutting off the cutting assembly in response to detecting a force applied to the cutting assembly. The force applied to the cutting assembly may be detected directly, for example, by force sensors, impact sensors, impulse sensors, or shock sensors, or the force applied to the cutting assembly may be detected indirectly, such as by detecting displacement of or pressure exerted by the cutting assembly in response to the force applied thereto.

The cutting assembly may be moveably mounted in the shredder housing for movement within the shredder housing.

The detector mechanism may be responsive to movement of the cutting assembly, pressure exerted upon the cutting assembly, or any other parameter related to a force exerted upon the cutting assembly.

The detector mechanism may be a mechanical switch, a linear transducer, a proximity sensor, or any other suitable mechanism.

The shredder may further include a container for collecting material shredded by the cutting assembly. The shredder housing may be disposed over an opening in the container.

Various aspects will become apparent to those skilled in the art from the following detailed description and the accompanying drawings.

DETAILED DESCRIPTION

While the term "paper shredder" generally refers to a device for shredding, e.g. cutting, paper, it must be understood that as used herein the term "paper shredder" may include devices capable of shredding more than paper. For example, a "paper shredder" may be able to cut plastic articles, such as credit cards, CDs/DVDs, and the like.

Figure 1:
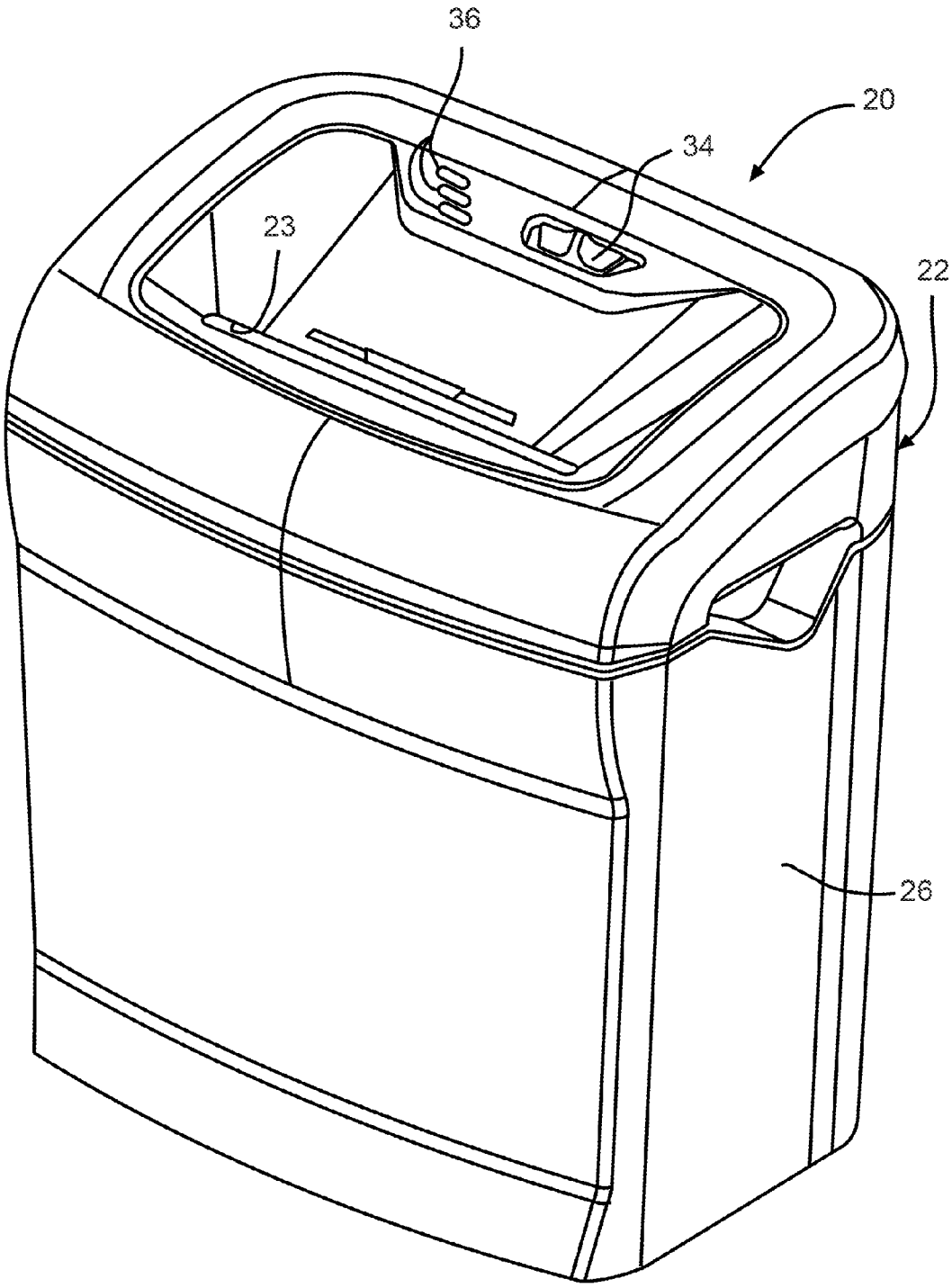
FIG. 1 is a perspective view of a shredder.
Figure 2:
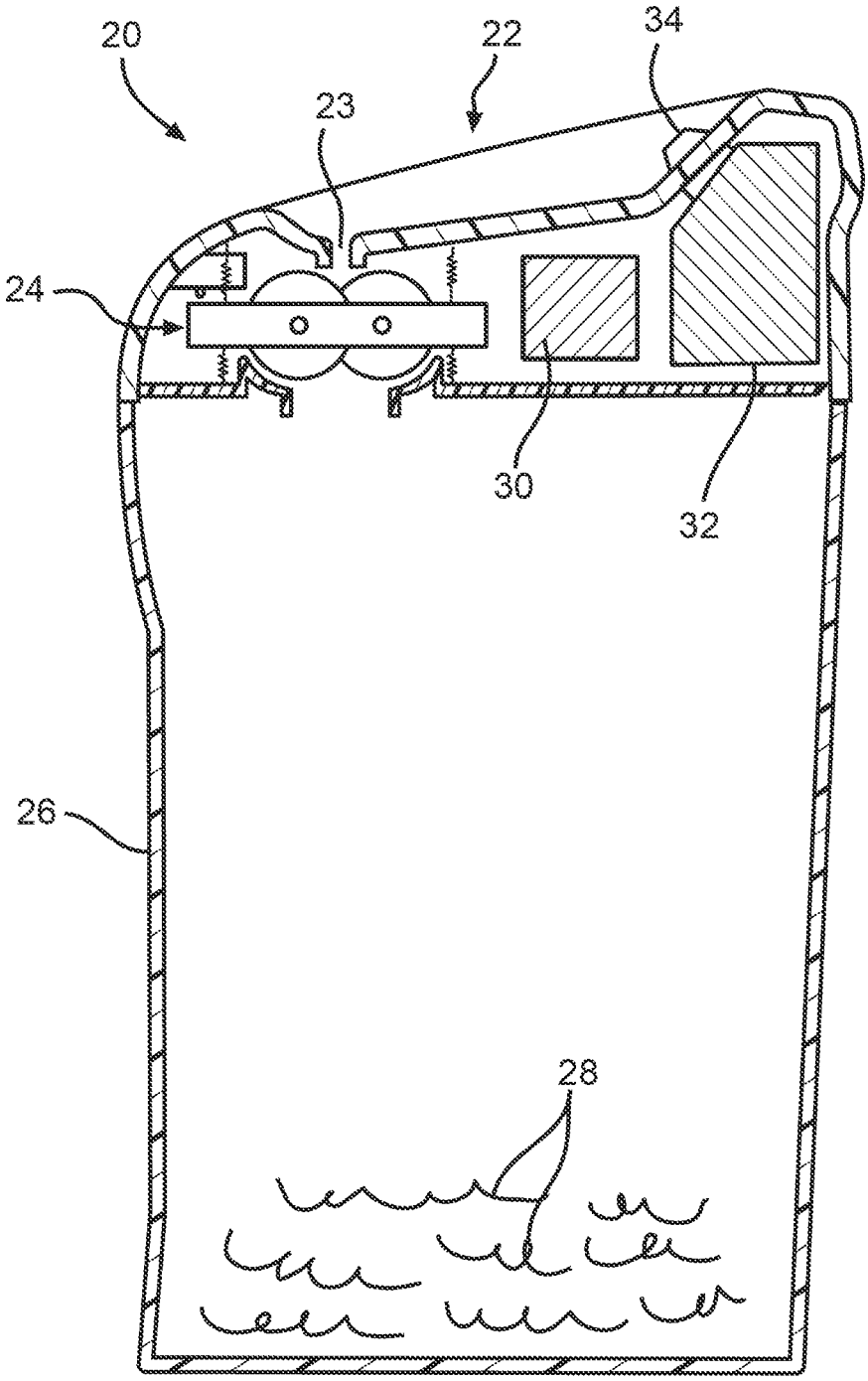
FIG. 2 is a cross sectional view of the shredder of FIG. 1.

Referring now to the drawings, there is illustrated in FIGS. 1 and 2 a material shredder 20, which may be used for shredding certain material, such as private, confidential or sensitive papers. The shredder 20 includes a shredder housing 22. The shredder housing 22 may, for example, be made of plastic, or other moldable material, sheet metal or any other suitable material. The shredder housing defines an insertion opening 23 for the passage of material to be destroyed, for example paper, electronically readable media and the like. A cutting assembly 24 capable of shredding material passed through the insertion opening 23 is mounted in the shredder housing 22. The insertion opening 23 may be relatively narrow, as compared to the thickness of a large enough amount of material that would jam the shredder 20 or as compared to the size of a human finger, thus as to reduce the likelihood of a jam in the cutting assembly 24 or the likelihood of a human finger reaching the cutting assembly 24.

The shredder housing 22 is disposed over a container, e.g. receptacle, 26 for collecting shredded material 28 which has been shredded by the cutting assembly 24. The container 26 defines a top opening through which paper cut in the shredder housing 22 may pass into the container 26. As illustrated, the shredder housing 22 is directly engaging the container 26, either resting on or secured thereto, although such is not required. The shredder housing 22 may be secured, as desired, to the container 26, for example, by threaded fasteners, plastic clips, spring-loaded ball detent mechanism, or any other suitable manner. Additionally, the shredder housing 22 may engage the container 26 in a nested relation. Further, the shredder housing 22 and the container 26 may be formed as an integral unit. Additionally, it must be understood that the shredder housing 22 is not necessarily intended to be associated the container 26 exclusively. The shredder housing 22 may be configured or constructed to be used with a variety of other receptacles. The shredder housing 22 may also include optional handles, either molded in or later attached, for ease of removing and placing the shredder housing 22 off of and on to the container 26.

A power supply 30 for providing power to drive the cutting assembly 24 is associated with the shredder housing 22. As illustrated the power supply 30 is disposed in the shredder housing 22, although such is not required. The power supply 30 may provide electrical power to the cutting assembly 24 in the case where the cutting assembly includes an electrically powered mechanical drive mechanism. Alternatively, the power supply 30 may provide mechanical power to the cutting assembly 24 in the case where the cutting assembly 24 is directly driven by mechanical power. In such a case, the power supply may, for example, be an electrically powered motor. In any case, the power supply 30 may provide power in any suitable fashion to drive the cutting assembly 24.

A control unit 32 for controlling the cutting assembly 24 and/or the power supply 30, and thereby the cutting assembly 24, is also associated with the shredder housing 22. As illustrated, the control unit 32 is disposed in the shredder housing 22, although such is not required. A control device 34, such as a switch, for manual engagement by a user for selectively operating the shredder 20 is disposed on the exterior of the shredder housing 22 and is operatively connected to the control unit 32. It is also contemplate that the control unit 32 may also be operated by remote control or automated control. The control device 34 may function to select the mode of shredder operation, e.g. on/off, manual/automatic, etc. Additionally, the control unit 32 and control device 34 may be optionally configured to operate the shredder 20 in a reverse manner, such as to release any material that may be in the cutting assembly 24 without having to pass any further therethrough. It is also contemplated that the control device 34 may optionally include a safety lock feature which requires that a user may have to perform a specific operation, such as hold the control device in a particular position for a predetermined amount of time, before the shredder 20 will activate.

A number of optional indicators 36 are also disposed on the exterior of the shredder housing 22. The indicators 36 may indicate any desired operational state of the shredder 20, such as power status, empty/full state of the container 26, the presence of a jam or activation of a safety shutoff or the like. It must be understood that the indicators 36 are optional features and need not necessarily be included in the shredder 20.

Figure 3:
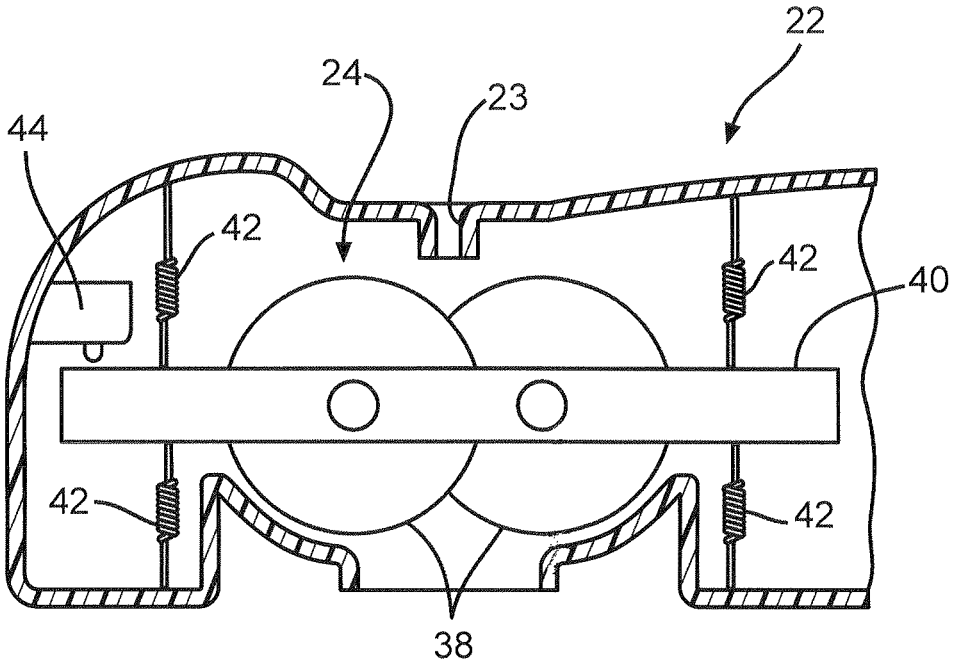
FIG. 3 is an enlarged view of a portion of FIG. 2.

As best shown in FIG. 3, the cutting assembly 24 includes sets of blades 38 mounted in a chassis 40. In particular, two opposing sets of blades may be included, each comprised of individual cutter blades 38 mounted on generally elongate shafts. In the figures, the blades 38 are illustrated as a pair of intermeshing disks for cutting paper when in driven rotation. As such the cutting assembly may include cutting elements driven by conventional mechanical motion. However, it must be understood that the blades 38 may have any suitable configuration and be in any suitable number for the shredding of material, such as paper, or the like. For example, the cutting assembly 24 may also include longitudinal, helical, or irregularly shaped blades or any other suitable blade geometry, which may be driven in a vibrating or reciprocal manner or any other suitable fashion.

The chassis 40 may be attached to the shredder housing 22, at least in part, with resilient springs 42. In this manner the cutting assembly 24 is moveably mounted in the shredder housing 22 for movement with respect to the shredder housing 22.

A detector mechanism 44 capable detecting a force applied to the cutting assembly 24 is also disposed in the shredder housing 22. The detector mechanism may be responsive to movement of the cutting assembly 24, which may be induced by an applied force as described below. As illustrated the detector mechanism 44 may be a mechanical switch which responds to movement of the cutting assembly 24, which will also be further described below.

Figure 4:
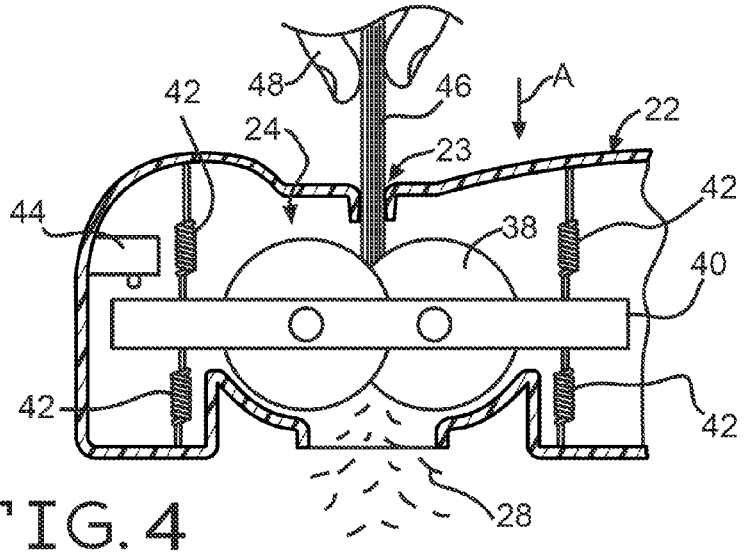
FIG. 4 is a view similar to FIG. 3 except showing the portion of the shredder during normal operation.

As shown in FIG. 4, during operation, material 46 to be shredded into shredded material 28 by the cutting assembly 24 may be inserted through the insertion opening 23 in the shredder housing 22, as indicated by arrow A, by a user 48. The shredded material 28 may then by collected in the container 26. The spring force and spring resistance of the springs 42 acting on the chassis 40 is preferably selected as to generally stably bias the cutting assembly 24 in the housing 22 during cutting by the blades 38 during a normal cutting operation. As such, the detection mechanism 44 typically remains inactivated during a normal cutting operation.

Figure 5:
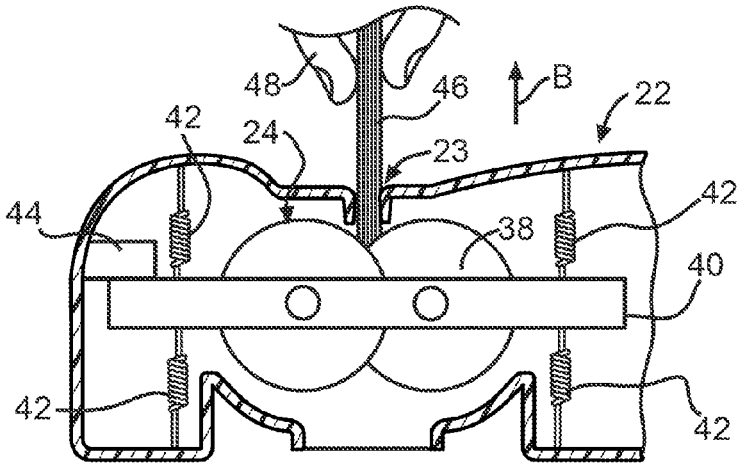
FIG. 5 is a view similar to FIG. 4 except showing the portion of the shredder in a first shutoff state.

As shown in FIG. 5, the user 48 may pull back on the material 46, as indicated by arrow B, against the direction of insertion of material 46. Upon application of this force by the user 48, the cutting assembly 24 may overcome the spring bias of the springs 42 and move to activate the detection mechanism 44.

Upon activation, the detection mechanism 44 will shut off operation of the cutting assembly 24 in response to the force applied to the cutting assembly 24. The detection mechanism 44 may, for example, send a signal to the control unit 32 to stop the shredding operation. Alternatively, the detection mechanism 44 may electrically disconnect the power supply 30 or the cutting assembly 24 from an electrical power source, or the detection mechanism 44 may mechanically disable the cutting assembly 24. Further, the detection mechanism 44 may perform any other suitable function to shutoff the operation of the cutting assembly 24.

Figure 6:
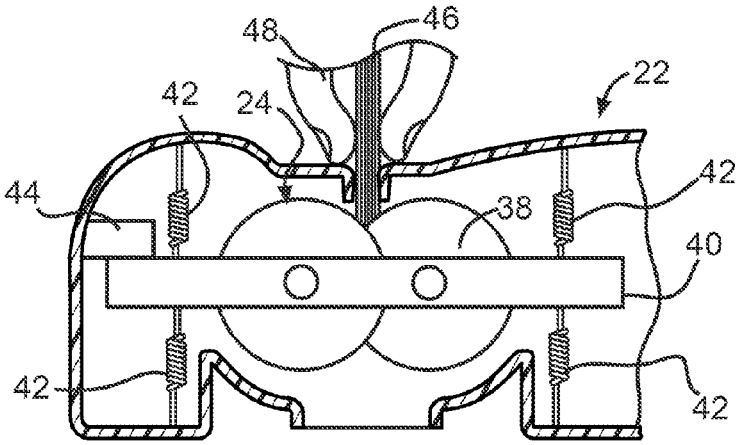
FIG. 6 is a view similar to FIG. 5 except showing the portion of the shredder in a second shutoff state.

Also, during operation a blockage may occur at insertion opening 23, such as a throat plate, for example, a paper jam or contact with the user 48 still holding onto the material 46, as shown in FIG. 6. When such a blockage occurs, the material 46 experiences resistance to further progress into the shredder housing 22. As such, this resistive force, in combination of the action of the blades 38, may act to overcome the spring bias of the springs 42 and the cutting assembly 24 may move to contact and activate the detection mechanism 44 as described above.

Figure 7:
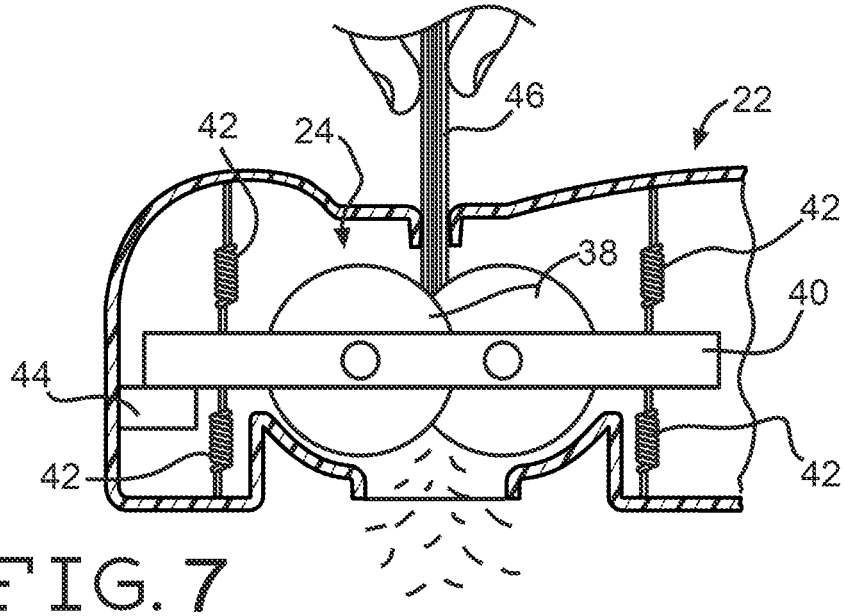
FIG. 7 is a view similar to FIG. 3 except showing a portion of a first alternative shredder during normal operation.
Figure 8:
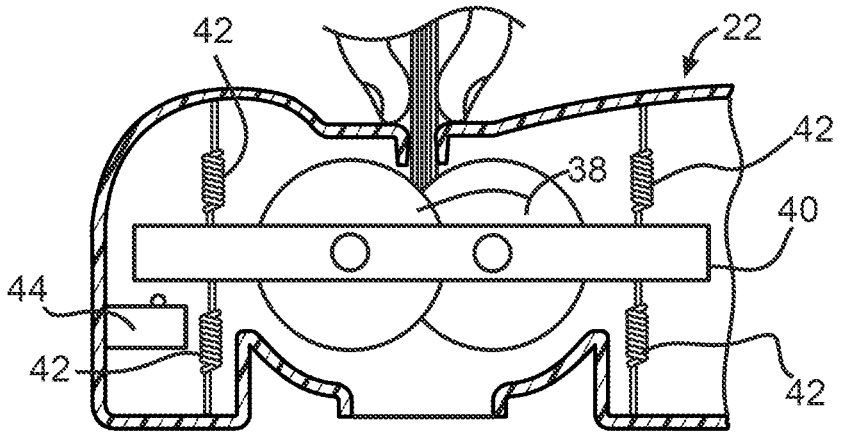
FIG. 8 is a view similar to FIG. 7 except showing the portion of the alternative shredder in a shutoff state.

There is shown in FIGS. 7 and 8 a portion of a first alternative material shredder 20 similar to that described above except showing the detection mechanism 44 in a normally inactive state while in contact with the chassis 40 during normal operation, as shown in FIG. 7, and activated for safety shutoff state when the cutting assembly 24 is displaced away from the detection mechanism 44 due to an acting force.

Figure 9:
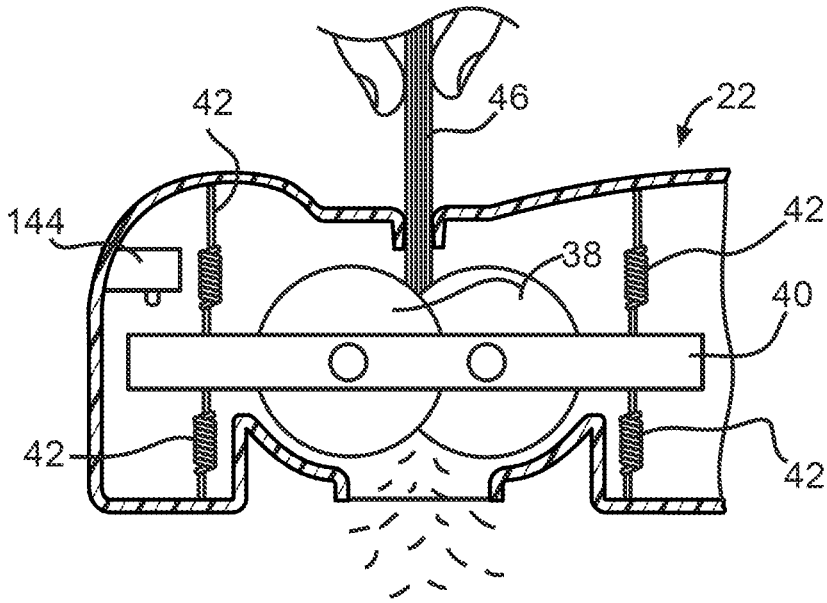
FIG. 9 is a view similar to FIG. 7 except showing a portion of a second alternative shredder during normal operation.
Figure 10:
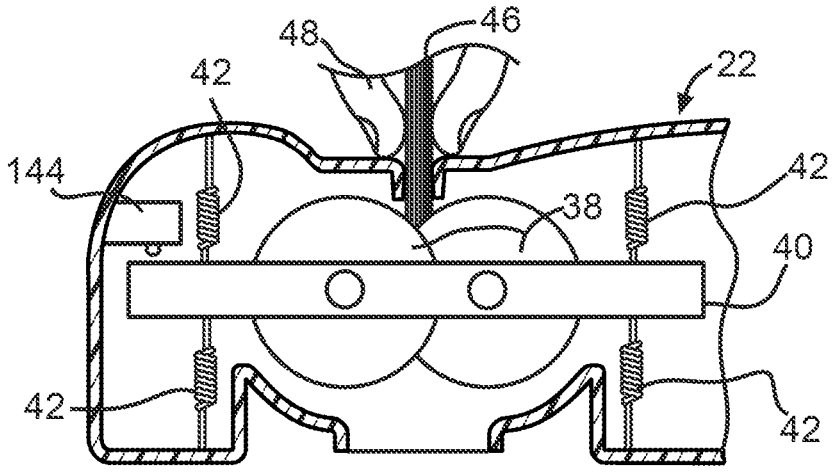
FIG. 10 is a view similar to FIG. 9 except showing the portion of the second alternative shredder in a shutoff state.

There is shown in FIGS. 9 and 10 a portion of a second alternative material shredder 20 similar to that described above except showing a detection mechanism 144 in the form of a proximity sensor. The detection mechanism 144 may be any suitable proximity sensor such as an led and optical reflectance sensor, radar distance detector, or any other suitable sensor or equipment to sense movement of the cutting assembly 24 due to a force exerted upon the cutting assembly 24. During operation the detection mechanism 144 senses for movement of the cutting mechanism 24 and upon detection of movement beyond a predetermined threshold, the detection mechanism 144 shuts down the cutting mechanism 24 as described above.

Additionally, it must be understood that the detection mechanism 144 may be any suitable non-contact detection mechanism, such as RFID locators, radar/echo sensors, photo gates, photo-electric sensors, ultrasonic sensors, and the like.

Figure 11:
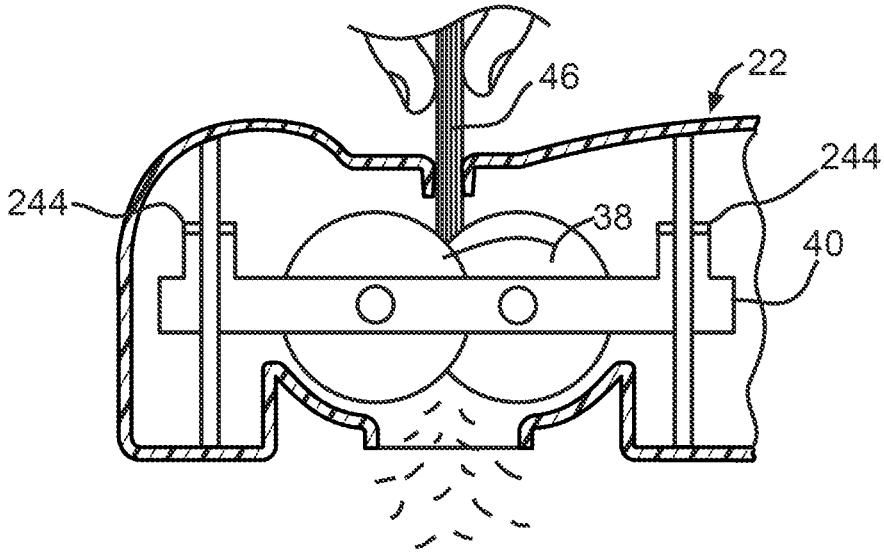
FIG. 11 is a view similar to FIG. 9 except showing a portion of a third alternative shredder during normal operation.
Figure 12:
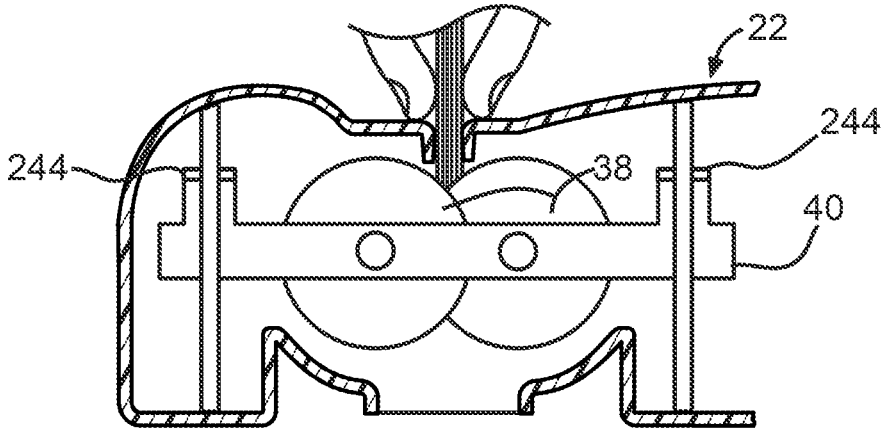
FIG. 12 is a, view similar to FIG. 11 except showing the portion of the third alternative shredder in a shutoff state

There is shown in FIGS. 11 and 12 a portion of a third alternative material shredder 20 similar to that described above except showing a detection mechanism 244 in the form of a linear transducer. The detection mechanism 244 may be any suitable sensor such as to detect displacement of the cutting assembly 24 due to a force exerted upon the cutting assembly 24. During operation the detection mechanism 244 senses for displacement of the cutting mechanism 24 and upon detection of displacement beyond a predetermined threshold, the detection mechanism 244 shuts down the cutting mechanism 24 as described above.

Figure 13:
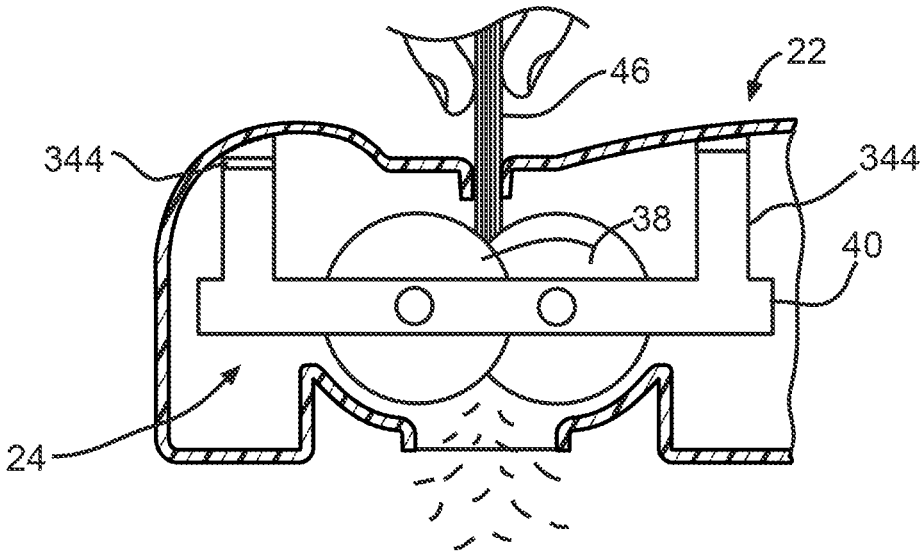
FIG. 13 is a view similar to FIG. 11 except showing a portion of a fourth alternative shredder during normal operation.
Figure 14:
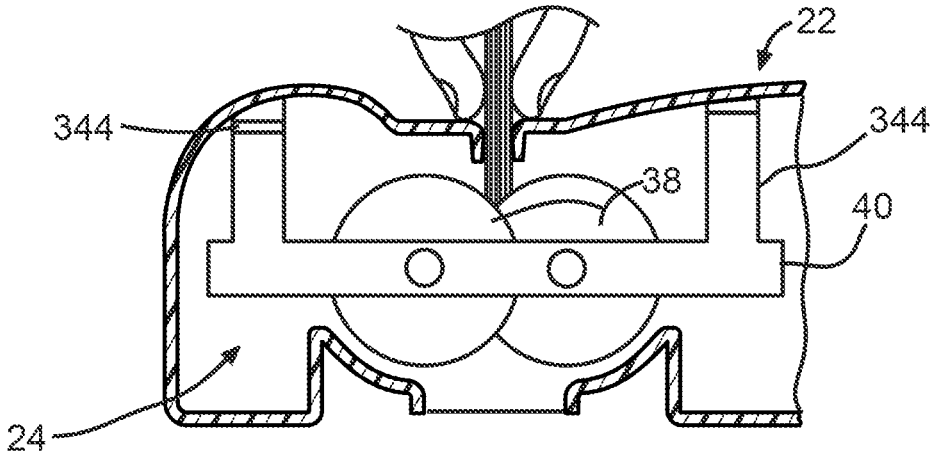
FIG. 14 is a view similar to FIG. 13 except showing the portion of the fourth alternative shredder in a shutoff state.

There is shown in FIGS. 13 and 14 a portion of a fourth alternative material shredder 20 similar to that described above except that the cutting mechanism is generally immobily mounted to the shredder housing 22 and includes a detection mechanism 344 in the form of a pressure sensor. The detection mechanism 344 may be any suitable sensor such as to detect a pressure generated by the cutting assembly 24 due to a force exerted upon the cutting assembly 24. During operation the detection mechanism 344 senses for a pressure from the cutting mechanism 24, for example against the shredder housing 22, and upon detection of a pressure above or below a predetermined threshold, the detection mechanism 344 shuts down the cutting mechanism 24 as described above.

In any case, it must be understood that the shredder 20 may include any detector mechanism capable of shutting off the cutting assembly 24, either directly or indirectly, in response to detecting a force applied to the cutting assembly 24. The force applied to the cutting assembly 24 may be detected by direct force sensing, monitoring of movement or displacement, pressure sending, shock or impulse sensing, mechanical or electrical action, or any other manner in which the detector mechanism may detect a force applied to the cutting assembly 24.

While principles and modes of operation have been explained and illustrated with regard to particular embodiments, it must be understood, however, that this may be practiced otherwise than as specifically explained and illustrated without departing from its spirit or scope.

What is claimed is:

1. A shredder system comprising:

a cutting assembly including sets of blades mounted on generally elongate shafts mounted in a chassis for mounting in a shredder housing, said cutting assembly capable of shredding paper, and a detector mechanism capable of shutting off said cutting assembly in response to detecting movement of said cutting assembly due to an applied force applied to said cutting assembly.

2. The shredder system of claim 1 where said detector mechanism is a mechanical switch.

3. The shredder system of claim 1 where said detector mechanism is a linear transducer.

4. The shredder system of claim 1 where said detector mechanism is a proximity sensor.

5. The shredder system of claim 1 where said detector mechanism is responsive to pressure associated with the force applied to said cutting assembly.

6. A paper shredder comprising:

a shredder housing, a cutting assembly including sets of blades mounted on generally elongate shafts mounted in a chassis moveably mounted in said shredder housing for movement within said shredder housing, said cutting assembly capable of shredding paper, and a detector mechanism capable of shutting off said cutting assembly in response to detecting an applied force applied to said cutting assembly relative to the housing.

7. The paper shredder of claim 6 where said detector mechanism is a mechanical switch.

8. The paper shredder of claim 6 where said detector mechanism is a linear transducer.

9. The paper shredder of claim 6 where said detector mechanism is a proximity sensor.

10. The paper shredder of claim 6 where said detector mechanism is responsive to pressure associated with the force applied to said cutting assembly.

11. The paper shredder of claim 6 further comprising a container for collecting paper shredded by said cutting assembly.

12. The paper shredder of claim 11 where said shredder housing is disposed over an opening in said container.

13. A method of shredding comprising the steps of:

a. providing a shredder including a shredder housing with a cutting assembly including sets of blades mounted on generally elongate shafts mounted in a chassis moveably mounted in said shredder housing for movement within said shredder housing, said cutting assembly capable of shredding paper, and a detector mechanism capable of shutting off the cutting assembly in response to detecting an applied force applied to the cutting assembly relative to the housing, b. inserting material to be shredded by the cutting assembly into the shredder housing, c. detecting a force applied to the cutting assembly with the detector mechanism, and d. shutting off the cutting assembly in response to the force applied to the cutting assembly.

14. The method of 13 where the cutting assembly provided in step a. is moveably mounted in the shredder housing for movement within the shredder housing.

15. The method of claim 13 where the detecting in step c. includes detecting movement of the cutting assembly.

16. The method of claim 15 where the detector mechanism is a mechanical switch.

17. The method of claim 15 where the detector mechanism is a linear transducer.

18. The method of claim 15 where the detector mechanism is a proximity sensor.

19. The method of claim 13 where said detector mechanism is responsive to pressure associated with the force applied to said cutting assembly.

20. The method of claim 13 where the shredder provided in step a. further includes a container and the method further comprises step:

e. collecting paper shredded by the cutting assembly in the container.

21. The method of claim 20 where the shredder housing is disposed over an opening in the container.

* * * * *